US005961063A

United States Patent [19]

Parry

[11] Patent Number: 5,961,063

[45] Date of Patent: Oct. 5, 1999

[54] HAND PROTECTOR AND BRAKING DEVICE FOR STRETCH FILM ROLL

[75] Inventor: David Parry, Severna Park, Md.

[73] Assignee: J. C. Parry & Sons Co., Inc., Baltimore, Md.

[21] Appl. No.: 08/938,313

[22] Filed: Sep. 26, 1997

Related U.S. Application Data

[60] Provisional application No. 60/035,076, Jan. 9, 1997.

[51] Int. Cl.[6] ..... B65H 23/06; B65D 85/02

[52] U.S. Cl. ..... 242/422.4; 242/422.9; 242/588

[58] Field of Search ..... 242/422.4, 422.9, 242/550, 588

[56] References Cited

U.S. PATENT DOCUMENTS

| | | | |
|---|---|---|---|
| 4,372,500 | 2/1983 | Saraisky | 242/613.5 |
| 4,530,473 | 7/1985 | Parry | 242/422.4 X |
| 4,582,273 | 4/1986 | Saraisky | 242/96 |
| 4,722,493 | 2/1988 | Parry et al. | 242/96 |
| 4,834,312 | 5/1989 | Riemenschneider, III | 242/96 |
| 5,203,517 | 4/1993 | Parry et al. | 242/96 |
| 5,351,905 | 10/1994 | Ferber | 242/588.2 |
| 5,398,884 | 3/1995 | Stanford | 242/588 |

OTHER PUBLICATIONS

CRC Handbook of Chemistry and Physics, 64th Edition, p. F–17, 1983.

*Primary Examiner*—John Q. Nguyen
*Attorney, Agent, or Firm*—Shoemaker and Mattare, Ltd.

[57] ABSTRACT

A device for protecting the fingers while applying stretch film under tension from a roll of film wound on a core by braking the core manually from within. The device is a unitary flexible plastic body including a generally cylindrical hollow body sized to fit within the core, and a flexible brim at one end of the body. The brim has substantial width, so that it can be folded over the end of the core, and braking force can then be delivered to both the inside and to the outside of the core by inserting at least one finger into the device and then squeezing the core between the thumb and finger.

8 Claims, 1 Drawing Sheet

HAND PROTECTOR AND BRAKING DEVICE FOR STRETCH FILM ROLL

This application claims priority from U.S. provisional patent application Ser. No. 60/035,076, filed Jan. 9, 1997.

BACKGROUND OF THE INVENTION

This invention relates to the art of packaging and more particularly to a device for protecting the hand while dispensing stretch film from a hand-held roll.

Stretch film such as low density linear polyethylene is produced in large rolls by major manufacturers. A number of companies rewind the film into small rolls, and repackage it for stretch wrapping items from pallets loaded with boxes to much smaller individual items. When stretch film is applied to an object, it must be maintained under tension sufficient to produce substantial stretching. A number of machines exist for applying stretch film to pallet loads. The pallet may be rotated, or the roll may be caused to orbit around the pallet, but in any event, a braking force is maintained on the roll, normally on its paper core, to produce the desired stretch.

Several devices have also been proposed that allow one to dispense film from a hand-held roll. Many of these—those designed for larger rolls—must be held with two hands, but film from rolls only a few inches in width can be applied with one hand, and corresponding one-handed dispensing/braking devices are available.

U.S. Pat. Nos. 4,372,500, 4,722,493, 4,582,273, 5,398,884, 5,351,905, 4,834,312 and 5,203,517 are representative of prior inventions in this field.

Most of the prior devices for small rolls either require a roll of film wound on a long core, so that the ends of the core are available for external braking, or they have an element which is inserted into the core, to apply internal braking. Braking a roll by inserting a finger is difficult, and the heat developed by braking friction can "burn" the fingers or thumb.

SUMMARY OF THE INVENTION

An object of the invention is to provide a simple device which will allow one to dispense stretch film from a roll with either one or two hands, while applying a braking force to the roll.

Another object of the invention is to protect the fingers and thumb from the heat developed during braking.

These and other objects are attained by a device for protecting the fingers while applying stretch film under tension from a roll of film wound on a core by braking the core manually from within. The device is a unitary flexible item including a generally cylindrical hollow body sized to fit within the core and having external ribs, and a flexible peripheral collar or brim at one end of the body. The brim width is substantial so that the flange can be folded over the outside of the core, and braking force can then be delivered to both the inside and to the outside of the core by inserting at least one finger into the device and then squeezing the core between the thumb and finger.

BRIEF DESCRIPTION OF THE DRAWINGS

In the accompanying drawings.

DESCRIPTION OF THE PREFERRED EMBODIMENT

Figure 1:
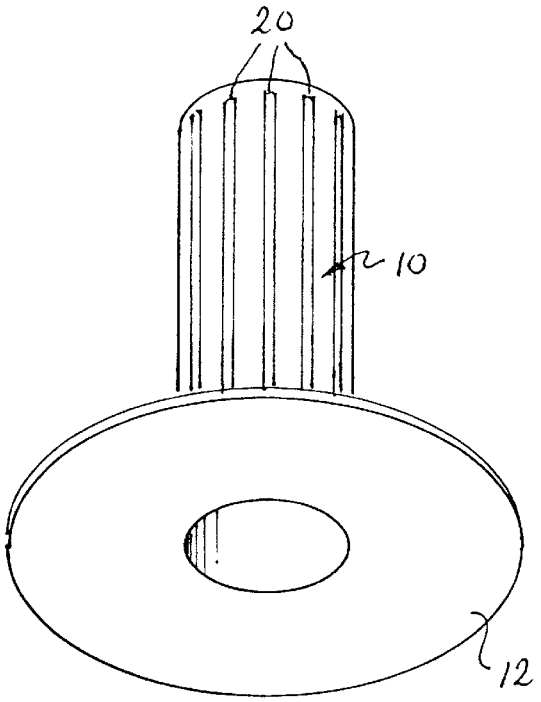
FIG. 1 is an isometric view of a hand protector embodying the invention.
Figure 2:
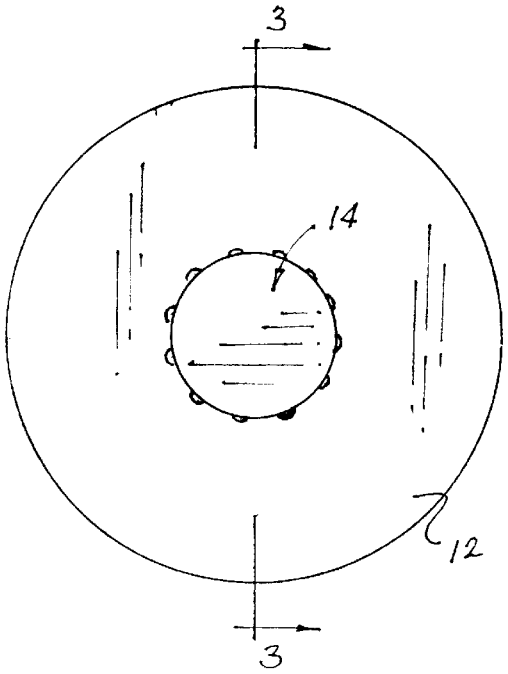
FIG. 2 is a top view thereof.
Figure 3:
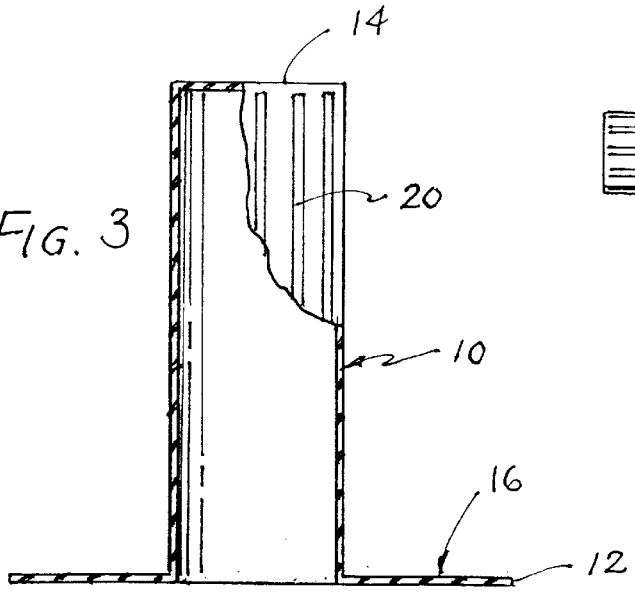
FIG. 3 is a partial sectional view taken on the line 3—3 in FIG. 2.

A combined brake and hand protector embodying the invention is shown in FIGS. 1–3. The device is molded in a single piece from a flexible synthetic polymer material having a high coefficient of friction (at least 0.20) against paper, so that only moderate hand pressure is required to stretch the film. Details of the molding process are a matter of ordinary skill.

The protector has the shape of a top hat, with a cylindrical body 10 and a substantial brim 12 at one end. The opposite end 14 preferably is closed, but could be open if desired. The outer diameter of the body is slightly less than the inside diameter of the intended film core, while the outer diameter of the brim is substantially greater than the outer diameter of the film core. This way, the top surface 16 of the brim can brake the outside of the roll as shown in FIG. 4.

Figure 4:
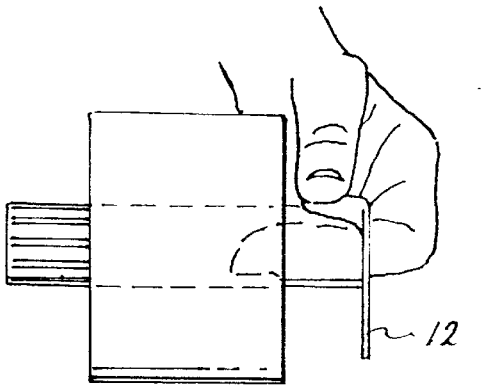
FIG. 4 is an illustration of the device in use.

The cylindrical outside of the body is provided with a number of equally spaced longitudinal ribs 20 which bear outward against the inside of the core when finger pressure is applied in reaction to squeezing with the thumb, as shown in FIG. 4. Preferably, each rib extends substantially the entire length of the body. As film is payed out onto the item being wrapped, the material mass of the device distributes frictionally generated heat over a broad area of the finger, preventing localized discomfort to the user. Of course, the harder one brakes the film, and the faster one works, the more heat is generated per unit time. It may be necessary to moderate one parameter or the other to prevent excessive heat build-up in the device.

While only one applicator device has been illustrated, they may be used in pairs to handle longer rolls, one at either end. The construction and function of the devices is identical in either case.

The exact dimensions of the device may vary according to the invention in its broadest sense, but in general, the body should be sufficiently long (about three inches) to protect the entire finger(s), and the brim should be sufficiently wide (at least one inch) to protect the thumb.

Since the invention is subject to modifications and variations, it is intended that the foregoing description and the accompanying drawings shall be interpreted as only illustrative of the invention defined by the following claims.

I claim:

1. A device for protecting the fingers while applying stretch film under tension from a roll of film wound on a hollow core by braking the core manually from within, the device comprising a generally cylindrical hollow body having an outer diameter slightly less than the inside diameter of the core sized to fit within the core, a flexible brim at one end of the body, formed of a flexible material having a coefficient of friction of at least 0.20 against paper, said brim having an outside diameter substantially greater than that of the core so that the brim can be folded over the outside of the core, and braking force can then be delivered to both the inside and to the outside of the core by inserting at least one finger into the device and then squeezing the core between the thumb and finger.

2. The invention of claim 1, wherein the body and the brim are molded as one from said flexible material.

3. The invention of claim 1, wherein the brim is at least one inch wide, and the body is at least three inches long.

4. The invention of claim 1, further comprising a plurality of longitudinal ribs on the outer surface of said body, for engaging the inner surface of the core.

5. The invention of claim 4, wherein said ribs are equally spaced about the circumference of the body.

6. The invention of claim 4, wherein all of said ribs extend substantially the entire length of said body.

7. The invention of claim 1, wherein the brim has a width in the radial direction at least equal to that of the thumb, and the body is at least as long as the finger.

8. A method of wrapping an article with stretch film from a small roll of film having a hollow core whose ends protrude from the roll, said method comprising steps of inserting into the core a cylindrical hollow body having an outer diameter slightly less than the inside diameter of the core having a flexible brim at one end, placing a finger within the hollow body, folding the rim over one protruding end of the core, and squeezing the folded rim between the finger and the thumb to generate a braking torque on the core so as to maintain substantial tension in said film.

* * * * *